United States Patent [19]

Shewchenko et al.

[11] Patent Number: 5,044,019

[45] Date of Patent: Sep. 3, 1991

[54] HELMET RESTRAINING DEVICE

[75] Inventors: Nicholas Shewchenko, Hull; Bjarki Halgrimsson, Ottawa, both of Canada

[73] Assignee: Biokinetics and Associates Ltd., Ottawa, Canada

[21] Appl. No.: 583,651

[22] Filed: Sep. 17, 1990

[30] Foreign Application Priority Data

Sep. 28, 1989 [CA] Canada ..... 613848

[51] Int. Cl.[5] ..... A42B 7/00

[52] U.S. Cl. ..... 2/421; 2/416; 2/417

[58] Field of Search ..... 2/8, 416, 417, 418, 2/419, 420, 421

[56] References Cited

U.S. PATENT DOCUMENTS

| | | | |
|---|---|---|---|
| 2,763,006 | 9/1956 | Amundsen | 2/8 |
| 2,973,522 | 3/1961 | Edwards et al. | 2/8 |
| 2,983,923 | 5/1961 | Aileo | 2/418 |
| 3,025,525 | 3/1962 | Larson | 2/419 |
| 3,075,201 | 1/1963 | Lindblom | 2/8 |
| 3,388,405 | 6/1968 | Simpson et al. | 2/418 |
| 3,696,442 | 10/1972 | Amundsen et al. | 2/8 |
| 4,051,555 | 10/1977 | Daly | 2/412 |
| 4,056,852 | 11/1977 | Greendale | 2/417 |
| 4,263,679 | 4/1981 | Erlendson | 2/420 |
| 4,293,960 | 10/1981 | Palmaer | 2/416 |

FOREIGN PATENT DOCUMENTS

| | | | |
|---|---|---|---|
| 790809 | 2/1958 | United Kingdom | 2/419 |

*Primary Examiner*—Werner H. Schroeder
*Assistant Examiner*—Michael A. Neas
*Attorney, Agent, or Firm*—George A. Seaby

[57] ABSTRACT

Existing devices for stabilizing a safety helmet such as a hard hat are either unduly complicated or ill adapted as retrofits for existing helmets. A simple restraining device for use on new or existing helmets includes a bracket located at the center of the interior of each side of the helmet for pivotally supporting front and rear headbands. Pins extending through the headbands into arcuate slots in the brackets limit rotation of the front and rear headbands with respect to the brackets. A force tending to lift or rotate the helmet from the wearer's head will cause the headbands to pivot downwardly and inwardly against the wearer's head, thus inhibiting removal thereof from the head of the wearer.

3 Claims, 2 Drawing Sheets

HELMET RESTRAINING DEVICE

BACKGROUND OF THE INVENTION

1. Field of the Invention

This invention relates to a helmet restraining device, and in particular to a restraining device for use on a safety helmet.

2. Discussion of Prior Art

While the device was specifically designed for use in a hard hat, it will be appreciated that the device can be used on other helmets.

As mentioned in applicant's co-pending Canadian Patent Application Serial No. 597,064, filed Apr. 18, 1989, a common problem with safety helmets, particularly hard hats is that of stabilizing the helmet on a wearer's head. It is not uncommon to see construction workers with hard hats tilted back on their heads to prevent the hats falling down over their eyes. In general, the strap systems used in safety helmets tend to be somewhat complicated and fail to provide a satisfactory solution to the problem of helmet stability and retention. Examples of patented strap systems for use in helmets are found in U.S. Pat. No. 2,983,923, which issued to J.A. Aileo on May 16, 1961; U. S. Pat. No. 3,025,525, which issued to G. M. Larson on Mar. 20, 1962; U.S. Pat. No. 4,051,555, which issued to N. Daly on Oct. 4, 1977; U.S. Pat. No. 4,056,852, which issued to J. H. Greendale on Nov. 8, 1977 and U.S. Pat. No. 4,263,679, which issued to R. R. Erlendson on Apr. 28, 1981.

While the structures described in the above listed patents are more or less effective, a need still exists for a restraining device, which securely retains a helmet on a wearer's head.

The object of the invention is to meet the above defined need by providing a restraining device for a helmet which improves helmet retention on the head of the wearer.

GENERAL DESCRIPTION OF THE DRAWINGS

Accordingly, the present invention relates to a helmet restraining device for stabilizing a helmet on the head of a wearer comprising bracket means for mounting on interior side walls of a helmet near the center thereof; first headband means pivotally connected at each end to one said bracket means for extending around the forehead of the wearer; second headband means pivotally connected at each end to one said bracket means for extending around the back of the wearer's head, whereby when the helmet rotates due to forward or rearward tilting forces, one said first or second strap means tightens against the wearer's head.

BRIEF DESCRIPTION OF THE DRAWINGS

The invention will be described in greater detail with reference to the accompanying drawings, which illustrate preferred embodiments of the invention, and wherein.

DESCRIPTION OF PREFERRED EMBODIMENT

Figure 1:
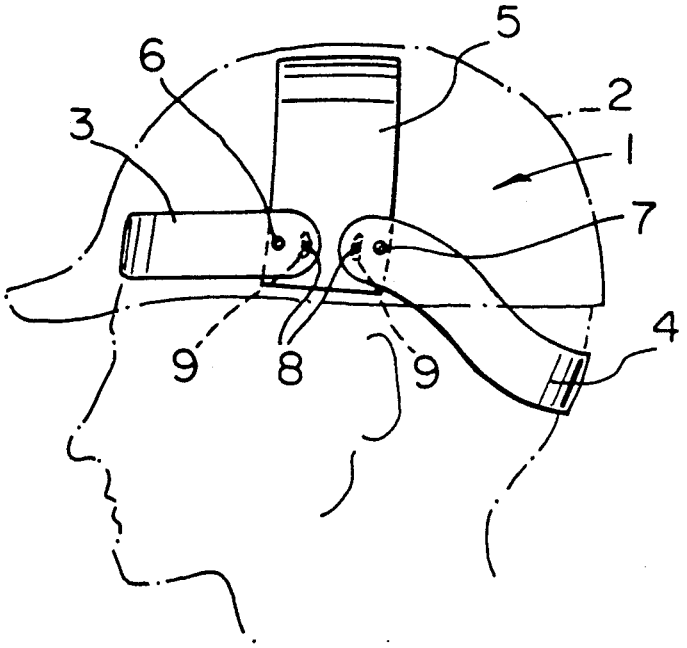
FIG. 1 is a side elevation view of a restraining device in accordance with the present invention installed in a safety helmet.
Figure 2:
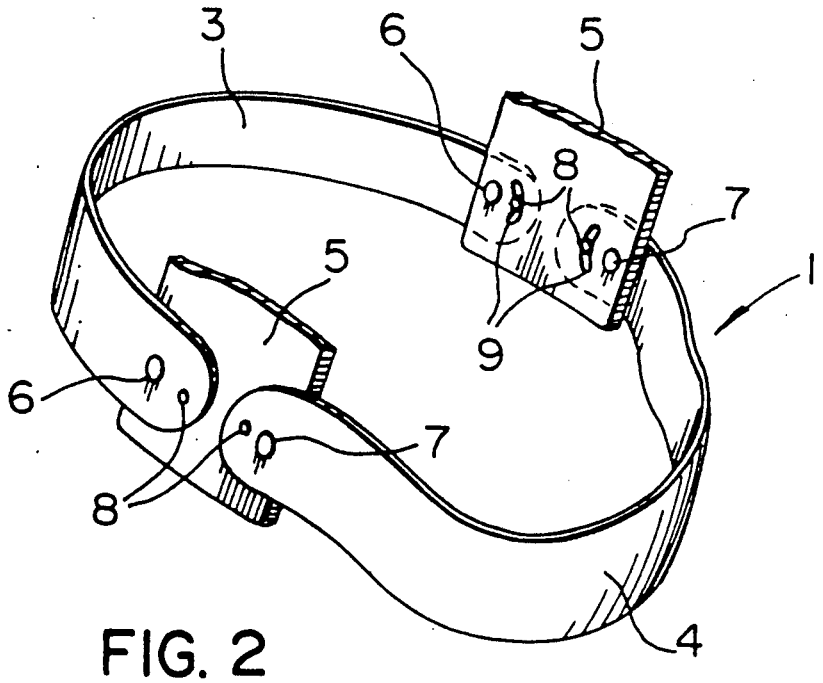
FIG. 2 is a perspective view from above and the rear of the restraining device of FIG. 1 with parts omitted.

With reference to FIG. 1, the restraining device of the present invention which is generally indicated at 1 is intended for use with a conventional safety helmet 2 of the type worn on construction sites. The structure 1 includes a pair of strip form headbands 3 and 4, the free ends of which are connected to brackets 5 for mounting the structure in the helmet 2. The brackets 5 are defined by strips of material, the upper ends of which are connected to the interior sides of the helmet 2. The free ends of the front and rear headbands 3 and 4, respectively are pivotally connected to the brackets 5 by pins defined by rivets or screws 6 and 7, respectively for rotation around the longitudinal axes of such screws 6 and 7. Rotation of the headbands 3 and 4 is restricted by pins 8 extending through the headbands and slots 9 in the brackets 5.

Figure 3:
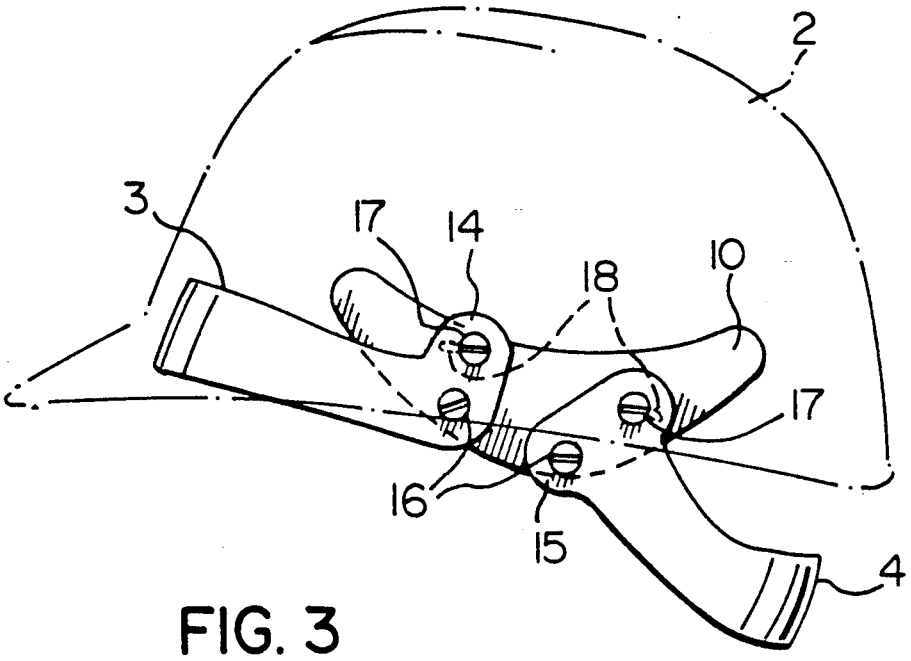
FIG. 3 is a side elevation view of a second embodiment of the restraining device installed in a safety helmet.
Figure 4:
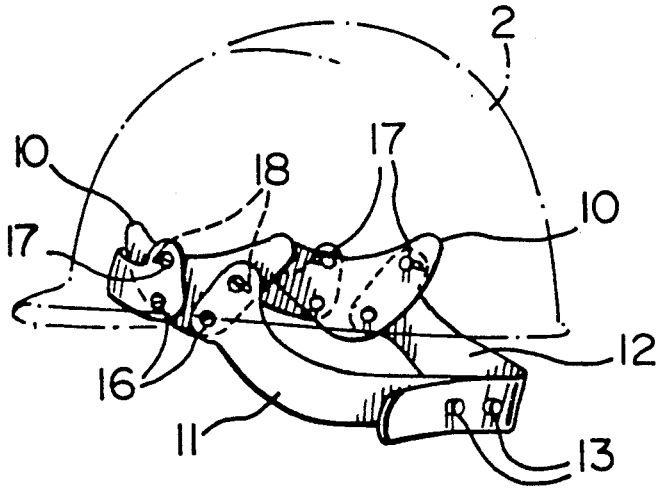
FIG. 4 is a schematic perspective view from the rear of the device of FIG. 3.

In a second embodiment of the invention (FIGS. 3 and 4),the brackets 10 take the form of the crescent-shaped strips attached to existing anchor points in current safety helmets 2. The rear headband 4 is defined by a pair of straps 11 and 12 (FIG. 4) interconnected by the rows of holes and posts 13 usually found in sports caps. Thus, the length of the rear headband 4 can readily be adjusted to suit the head of the wearer. It will be appreciated that the same adjustment structure can be used in the front headband 3. The enlarged free ends 14 and 15 (FIG. 3) of the headbands 3 and 4, respectively pivotally are connected to the strips 10 by pins defined by screws 16. Arcuate slots 18 are provided in the strips 10 for receiving the inner ends of the uppermost screws 17, thereby limiting rotation of the headbands 3 and 4 around the longitudinal axes of the lower screws 16.

In use, the lengths of the headbands 3 and 4 are adjusted to the head of the wearer. When the helmet 2 is subjected to front or rear loading, i.e. to a force tending to tilt the helmet forwardly or rearwardly, the helmet rotates slightly around the axes of the pins defined by the rivets or screws 6 and 7 or 16. Such action results in tightening of the headband 3 or 4 on the head of the wearer.

An upward force on the central bracket 5 or 10 causes the front and rear headbands 3 and 4 to pivot downwardly and inwardly, thus tightening onto the wearer's head. The larger the upward force, the larger the clamping action until a maximum load is exceeded. As a practical matter, the headbands 3 and 4 should not be allowed to rotate fully with respect to the brackets 5 or 10, since such rotation would inhibit donning and doffing of the hat. Moreover, by limiting the pivoting action of the restraining device, the stability of the helmet on the head is increased during normal use. The slots 9 or 18 and the pins 8 or 17 limit rotation of the helmet 2 relative to the restraining device, and consequently relative to the head of the wearer. The rotation permitted by the slots 9 or 18 is approximately 5°.

We claim:

1. A helmet restraining device for stabilizing a helmet on the head of a wearer comprising first bracket means for mounting on one interior side wall of a helmet near the center therefor; second bracket means for mounting on the other interior side wall of the helmet near the center thereof; first headband means for extending around the forehead of a wearer; second headband means for extending around the back of the wearer's head; first pin means pivotally connecting each said first and second headband means to said bracket means; second pin means extending through said first and second headband means; and slot means in said first and second bracket means for slidably receiving said second pin means for limiting rotation of said first and second headband means with respect to said first and second bracket means, whereby when the helmet lifts or rotates due to forward or rearward tilting forces, one said first or second headband means tightens against the wearer's head.

2. A helmet restraining device according to claim 1, wherein each said first and second bracket means includes a strip of material for extending upwardly from one said first and second headband means.

3. A helmet restraining device according to claim 1, wherein each said first and second bracket means includes a crescent-shaped strip of material for attachment to an existing anchor point in the interior of a safety helmet; and said second headband means includes a pair of interconnectable straps, whereby the length of the rear headband can be adjusted to suit the head of a wearer.

* * * * *